US010177540B2

(12) United States Patent
Ito

(10) Patent No.: US 10,177,540 B2
(45) Date of Patent: Jan. 8, 2019

(54) METHOD FOR MANUFACTURING SPARK PLUG

(71) Applicant: NGK Spark Plug Co., LTD., Nagoya (JP)

(72) Inventor: Takayuki Ito, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/548,279

(22) PCT Filed: Mar. 28, 2016

(86) PCT No.: PCT/JP2016/001782

§ 371 (c)(1),
(2) Date: Aug. 2, 2017

(87) PCT Pub. No.: WO2016/157882

PCT Pub. Date: Oct. 6, 2016

(65) Prior Publication Data

US 2018/0013267 A1 Jan. 11, 2018

(30) Foreign Application Priority Data

Mar. 31, 2015 (JP) ..... 2015-071006

(51) Int. Cl.
*H01T 21/02* (2006.01)
*H01T 13/20* (2006.01)

(52) U.S. Cl.
CPC ..... *H01T 21/02* (2013.01); *H01T 13/20* (2013.01)

(58) Field of Classification Search
CPC ..... H01T 21/02; H01T 13/20
See application file for complete search history.

(56) References Cited

U.S. PATENT DOCUMENTS 5,556,315 A * 9/1996 Kagawa ..... H01T 13/32 445/49
6,790,113 B1 * 9/2004 Fujita ..... H01T 21/02 140/71.5

(Continued)

FOREIGN PATENT DOCUMENTS

JP 53-18077 A 2/1978
JP 2004-146101 A 5/2004
JP 2005-243260 A 9/2005

OTHER PUBLICATIONS

International Search Report dated Jun. 7, 2016 for the corresponding PCT Application No. PCT/JP2016/001782.

*Primary Examiner* — Kevin Quarterman
(74) *Attorney, Agent, or Firm* — Leason Ellis LLP

(57) ABSTRACT

A method for manufacturing a spark plug including a center electrode that extends in an axial direction, a metal shell that is provided around an outer periphery of the center electrode, and a rod-shaped ground electrode whose base end is joined to the metal shell and whose distal end is bent towards an axial-line side. The method comprises a bending step of bending an unbent ground electrode, which is the ground electrode that is not yet bent, by pressing against it a predetermined curved surface of a bend spacer, wherein the bend spacer is formed so as to be divisible into two or more members including a first member and a second member. The first member includes a mounting portion for mounting the bend spacer on a fixing tool and the second member includes the predetermined curved surface that comes into contact with the unbent ground electrode.

6 Claims, 6 Drawing Sheets

(56) References Cited

U.S. PATENT DOCUMENTS

| | | | | |
|---|---|---|---|---|
| 7,346,983 | B2 * | 3/2008 | Oda | H01T 21/02 29/33 N |
| 8,371,889 | B2 * | 2/2013 | Kure | H01T 21/06 313/141 |
| 2002/0094743 | A1 * | 7/2002 | Harada | H01T 13/32 445/7 |
| 2004/0078972 | A1 * | 4/2004 | Hanai | H01T 21/02 29/857 |

* cited by examiner

METHOD FOR MANUFACTURING SPARK PLUG

CROSS-REFERENCE TO RELATED APPLICATIONS

This application is a U.S. National Phase Application under 35 U.S.C. § 371 of International Patent Application No. PCT/JP2016/001782, filed Mar. 28, 2016, and claims the benefit of Japanese Patent Applications No. 2015-071006, filed Mar. 31, 2015, all of which are incorporated herein by reference in their entirety. The International Application was published in Japanese on Oct. 6, 2016 as International Publication No. WO/2016/157882 under PCT Article 21(2).

FIELD OF THE INVENTION

The present invention relates to a spark plug.

BACKGROUND OF THE INVENTION

Hitherto, spark plugs have been used for ignition in internal combustion engines, such as gasoline engines. In spark plugs, by bending a distal end face of a ground electrode towards an axial line of a center electrode such that the distal end face opposes the center electrode, a spark discharge gap is formed between the center electrode and the ground electrode. With the ground electrode joined to a metal shell, the ground electrode is bent towards the center electrode by using a bend spacer (refer to, for example, Japanese Unexamined Patent Application Publication No. 2005-243260).

Technical Problem

In the method for manufacturing a spark plug described in Japanese Unexamined Patent Application Publication No. 2005-243260, when bending the ground electrode by using the bend spacer, a load acts upon the bend spacer as the ground electrode is bent. Therefore, as a contact portion of the bend spacer that contacts the ground electrode deteriorates, the accuracy of the spark discharge gap of the spark plug may be decreased. Therefore, it is an object to provide a technology for suppressing a decrease in the accuracy of a spark discharge gap of a spark plug.

SUMMARY OF THE INVENTION

Solution to Problem

The present invention is made for overcoming the above-described problem, and may be realized in the following forms.

(1) According to an aspect of the present invention, there is provided a method for manufacturing a spark plug including a center electrode that extends in an axial direction, a metal shell that is provided around an outer periphery of the center electrode, and a rod-shaped ground electrode whose base end is joined to the metal shell and whose distal end is bent towards an axial-line side. The method comprises a bending step of bending an unbent ground electrode, which is the ground electrode that is not yet bent, by pressing it against a predetermined curved surface of a bend spacer, wherein the bend spacer is formed so as to be divisible into two or more members including a first member and a second member, the first member including a mounting portion for mounting the bend spacer on a fixing tool, the second member including the predetermined curved surface that comes into contact with the unbent ground electrode. According to the method for manufacturing the spark plug of this aspect, since a bending load for bending the unbent ground electrode acts upon the bend spacer, the mounting portion or the predetermined curved surface may be broken due to stress resulting from the bending load. Since the bend spacer is formed so as to be divisible into two or more members including the first member and the second member, when the bend spacer has been broken, it is possible to replace only the broken member or the broken members and stably form a spark discharge gap in the spark plug with good accuracy. In addition, since it is possible to replace only the broken member or the broken member members, it is possible to reduce tool replacement costs. As a result, according to the method for manufacturing the spark plug, it is possible to reduce manufacturing costs of the spark plug.

(2) In the method for manufacturing the spark plug according to the aforementioned aspect, of the two or more members of the bend spacer, at least two of the members may be provided such that one of the two members includes a convex portion and the other of the two members includes a concave portion that is fitted to the convex portion. By forming such a structure, when one of the member having the concave portion and the member having the corresponding convex portion is replaced, it is possible to easily and properly combine the two members by fitting the concave portion and the convex portion to each other. Therefore, according to the method for manufacturing the spark plug, since it is possible to replace the member in a short time when the bend spacer has been broken, it is possible to suppress an increase in the manufacturing time of the spark plug, and to suppress a reduction in production efficiency.

(3) In the method for manufacturing the spark plug according to the aforementioned aspect and form, a toughness of the first member of the bend spacer is higher than a toughness of the second member, and a hardness of the second member is higher than a hardness of the first member. By forming such a structure, it is possible to properly suppress the occurrence of breakage of the first member and to properly suppress the occurrence of breakage of the second member.

(4) In the method for manufacturing the spark plug according to the aforementioned aspect and forms, the ground electrode may further include an electrode tip that is joined to the distal end and is disposed so as to oppose the center electrode with a predetermined gap therebetween; the bend spacer may include a grooved portion in the predetermined curved surface, the grooved portion being capable of accommodating the electrode tip; the grooved portion may include a first side surface disposed at a front end side of the second member of the bend spacer, a bottom surface that is continuous with the first side surface, and a second side surface that opposes the first side surface and that is continuous with the bottom surface; and the first side surface and the bottom surface may be connected to each other so as to be rounded to a radius R1, and the second side surface and the bottom surface may be connected to each other so as to be rounded to a radius R2, with the radius R1 being less than the radius R2. A portion of the bend spacer that includes the grooved portion tends to crack at a location where stress is concentrated. In the method for manufacturing the spark plug, when, in the grooved portion of the bend spacer, the radius R2 of a rounded portion of the connection portion between the second side surface and the bottom surface, where a larger stress is applied, is made larger than the radius R1 of a rounded portion of the first side surface and the bottom surface, it is possible to suppress the concentration of stress and to suppress the occurrence of breakage of the bend spacer. As a result, it is possible to reduce the time and costs required to replace the members of the bend spacer in the step of manufacturing the spark plug, suppress an increase in manufacturing costs of the spark plug, and suppress a reduction in production efficiency.

(5) The method for manufacturing the spark plug according to the aforementioned aspect and forms may comprise a replacing step of replacing any one of the members of the bend spacer that has been broken, the replacing step being performed before the bending step. According to this method, when the bend spacer has been broken, since only the broken member is replaced, it is possible to reduce tool replacement costs.

The present invention can be realized in various forms. For example, the present invention can be realized in the form of, for example, an apparatus for manufacturing a spark plug, a spark plug, or a sensor.

BRIEF DESCRIPTION OF THE DRAWINGS

These and other features and advantages of the present invention will become more readily appreciated when considered in connection with the following detailed description and appended drawing(s), wherein like designations denote like elements in the various views, and wherein.

DETAILED DESCRIPTION OF THE INVENTION

A. First Embodiment A-1. Structure of Spark Plug

Figure 1:
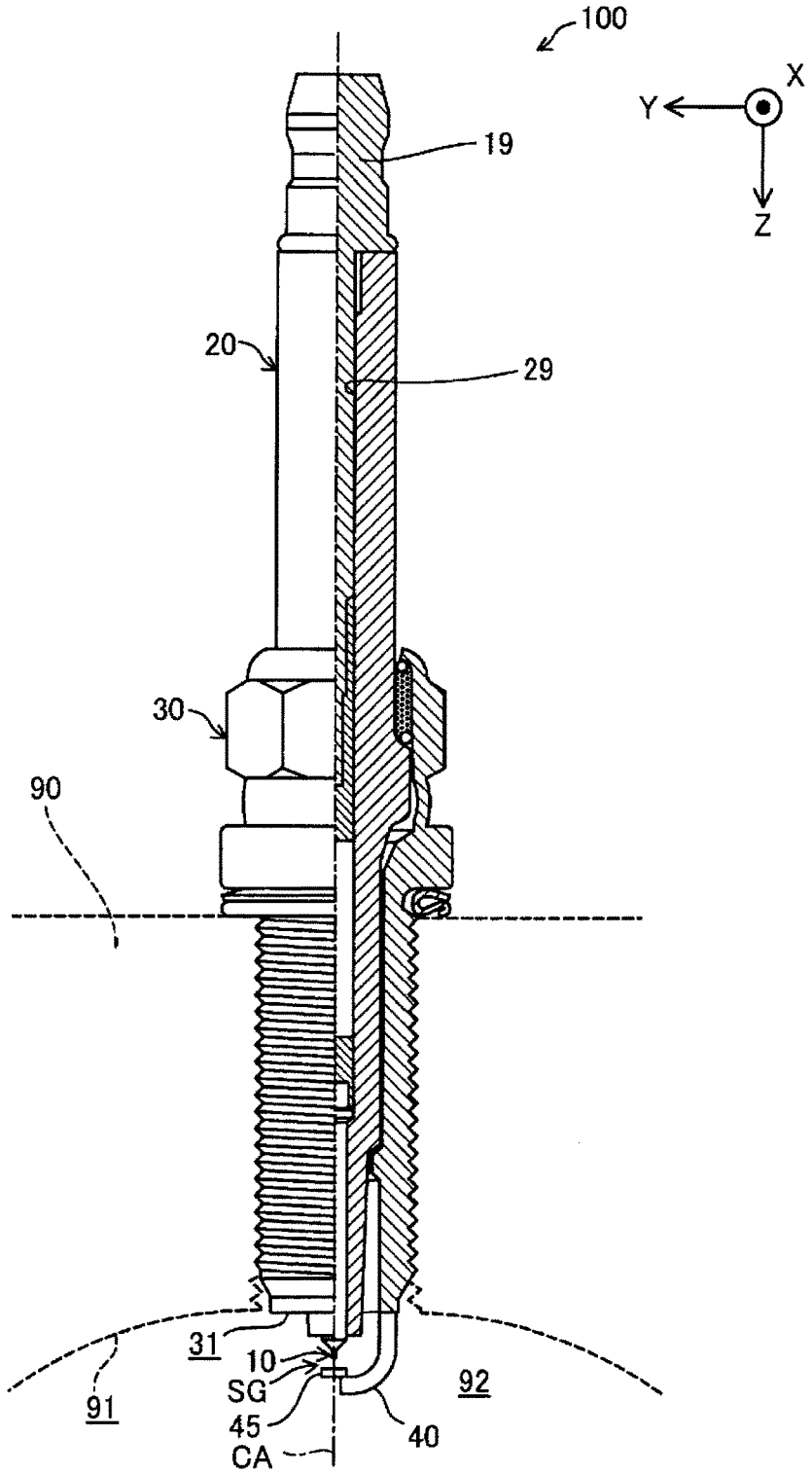
FIG. 1 is a partial sectional explanatory view of a spark plug.

FIG. 1 is a partial sectional explanatory view of a spark plug 100. In FIG. 1, with an axial line CA, which corresponds to an axis of the spark plug 100, being a boundary, an external shape of the spark plug 100 is illustrated on the left of the axial line CA in the plane of FIG. 1, and a cross sectional shape of the spark plug 100 is illustrated on the right of the axial line CA in the plane of FIG. 1. In the embodiment, a lower side of the spark plug 100 in the plane of FIG. 1 is called a "front end side", and an upper side of the spark plug 100 in the plane of FIG. 1 is called a "rear end side". In FIG. 1, an X axis, a Y axis, and a Z axis that are orthogonal to each other are drawn. The Z axis in FIG. 1 corresponds to an axis along the axial line CA. Of Z axis directions (axial directions) along the Z axis, a +Z axis direction corresponds to a direction from the rear end side to the front end side of the spark plug 100.

The spark plug 100 includes a center electrode 10, an insulator 20, a metal shell 30, and a ground electrode 40. In the embodiment, the axial line CA of the spark plug 100 also corresponds to the axis of the center electrode 10, the axis of the insulator 20, and the axis of the metal shell 30.

The front end side of the spark plug 100 has a spark discharge gap SG that is formed between the center electrode 10 and the ground electrode 40. The spark plug 100 is formed so as to be mountable on an internal combustion engine 90 with the front end side thereof where the spark discharge gap SG is formed protruding from an inner wall 91 of a combustion chamber 92. When, with the spark plug 100 mounted on the internal combustion engine 90, a high voltage (such as 10000 to 30000 volts) is applied to the center electrode 10, a spark discharge occurs in the spark discharge gap SG. The spark discharge that has occurred in the spark discharge gap SG causes an air-fuel mixture in the combustion chamber 92 to be ignited. The spark discharge gap SG in the embodiment may also be referred to as "a predetermined gap."

The center electrode 10 of the spark plug 100 is a conductive electrode. The center electrode 10 has a rod shape that extends in the direction of the axial line CA. An outer-side surface of the center electrode 10 is electrically insulated from the outside by the insulator 20. The front end side of the center electrode 10 protrudes from the front end side of the insulator 20. The rear end side of the center electrode 10 is electrically connected to a terminal metal shell 19 provided at the rear end side of the insulator 20.

The insulator 20 of the spark plug 100 is an electrically insulating glass. The insulator 20 has a cylindrical shape extending along the axial line CA as center. In the embodiment, the insulator 20 is formed by sintering an insulating ceramic material (such as alumina). The insulator 20 has an axial hole 29, which is a through hole extending in the direction of the axial line CA. With the center electrode 10 protruding from the front end side of the insulator 20, the center electrode 10 is held in the axial hole 29 in the insulator 20 so as to be on the axial line CA.

The metal shell 30 of the spark plug 100 is a conductive metallic body. The metal shell 30 has a cylindrical shape extending in the direction of the axial line CA. In the embodiment, the metal shell 30 is a member formed from a cylindrically molded low-carbon steel subjected to nickel plating. In other embodiments, the metal shell 30 may be a member subjected to zinc plating, or a member that is not plated (non-plated member). With the metal shell 30 being electrically insulated from the center electrode 10, the metal shell 30 is fixed to an outer surface of the insulator 20 by crimping. An end face 31 is formed at the front end side of the metal shell 30. From the center of the end face 31, the insulator 20, along with the center electrode 10, protrudes in the +Z axis direction (front end direction). The ground electrode 40 is joined to the end face 31.

The ground electrode 40 of the spark plug 100 is a conductive electrode. The ground electrode 40 has a rod shape. One end (also called a base end) of the ground electrode 40 is joined to the end face 31 of the metal shell 30. The ground electrode 40 is bent towards the axial line CA after extending in the +Z axis direction from the end face 31 of the metal shell 30. In the embodiment, the ground electrode 40 includes an electrode tip 45 at a distal end thereof. The electrode tip 45 is joined so as to protrude in a +Y axis direction from the distal end of the ground electrode 40, is disposed so as to oppose the center electrode 10, and defines the spark discharge gap SG between it and the center electrode 10. As illustrated, the position of the distal end of the ground electrode 40 in the Y axis direction is situated closer to a −Y axis side than the center electrode 10. That is, the ground electrode 40 is shorter in length than when the position of the distal end in the Y axis direction matches a center position of the center electrode 10. As a result, it is possible to reduce the electrode temperature of the ground electrode 40, and suppress the occurrence of breakage and oxidation of the ground electrode 40 caused by the reception of heat.

In the embodiment, the material of the ground electrode 40 is a nickel alloy whose main component is nickel (Ni). In the embodiment, the material of the electrode tip 45 is an alloy containing platinum (Pt) as a main component and 20% rhodium (Rh) by mass. In another embodiment, the material of the electrode tip 45 may be any material as long as it is one having excellent wear resistance with respect to spark discharge, and may be a pure noble metal (such as iridium (Ir), platinum (Pt), rhodium (Rh), and ruthenium (Ru)), or nickel (Ni), or an alloy containing at least one of these metals.

Figure 2:
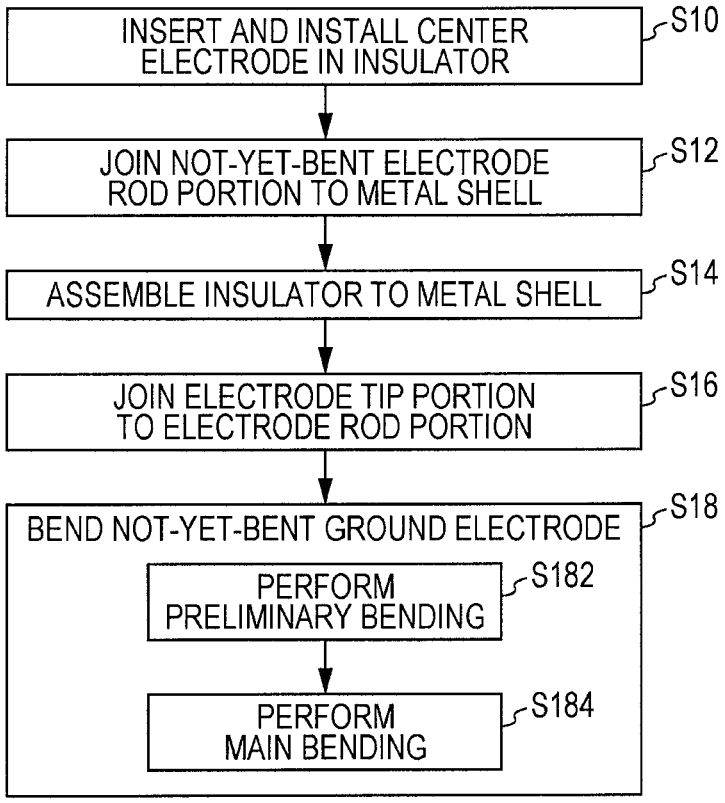
FIG. 2 illustrates steps for describing a method for manufacturing the spark plug.

FIG. 2 illustrates steps for describing a method for manufacturing the spark plug according to the embodiment. Components of the spark plug 100 are previously produced.

The center electrode 10 is inserted and installed in the axial hole 29 in the insulator 20 (Step S10). More specifically, the center electrode 10, a ceramic resistor, a sealing body, and the terminal metal shell 19 are inserted into the insulator 20 in a predetermined order, and these are integrated with each other by a heat compression step, which is called glass sealing.

Next, by resistance welding, the ground electrode 40 that is not yet bent (hereunder also called "not-yet-bent (unbent) ground electrode 40A") is joined to a front end face of the metal shell 30 before the insulator 20 is assembled to the metal shell 30 (Step S12).

The insulator 20 integrated with the center electrode 10 by the glass sealing is inserted into the metal shell 30, and a crimping portion of the metal shell 30 is crimped so as to be inwardly bent, so that the metal shell 30 and the center electrode 10 are assembled to each other (Step S14). By this, with the front end side of the center electrode 10 protruding from the front end side of the metal shell 30, the insulator 20 is integrally held by the metal shell 30.

By resistance welding, the electrode tip 45 is joined to an inner-side side surface of the not-yet-bent ground electrode 40A joined to the metal shell 30 (Step S16)). Accordingly, a member in which the not-yet-bent ground electrode 40A is welded to the metal shell 30 is also called a workpiece.

The not-yet-bent ground electrode 40A is bent (Step S18). The bending step (Step S18) includes preliminary bending in which the not-yet-bent ground electrode 40A is bent to a bending radius R (Step S182), and main bending in which the spark discharge gap SG is formed between the center electrode 10 and the electrode tip 45 (Step S184). In Step S182, the preliminary bending is performed by using a preliminary bending device 300.

Figure 3:
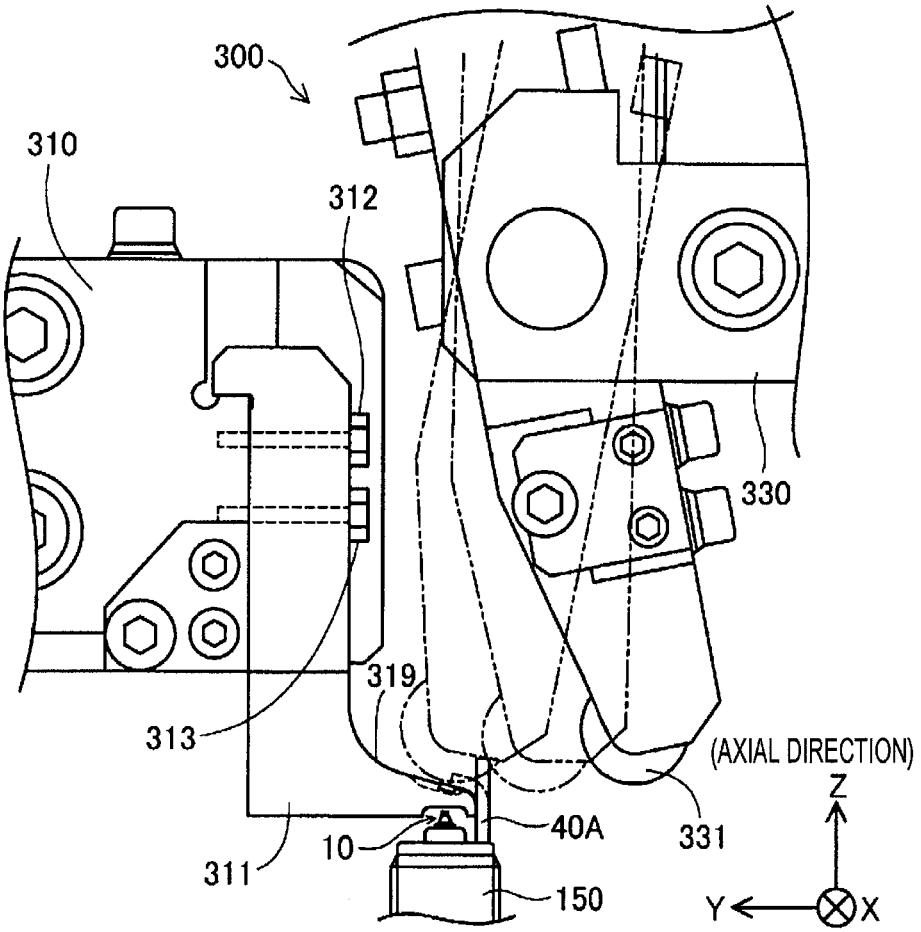
FIG. 3 is an enlarged explanatory view of a main portion of a preliminary bending device.

FIG. 3 is an enlarged explanatory view of a main portion of the preliminary bending device 300. The preliminary bending device 300 includes a bend spacer positioning mechanical section 310, a bend spacer 311, a bend mechanical section 330, and a bend roller (bend tool) 331 (see FIG. 3). The bend spacer positioning mechanical section 310 according to the embodiment may also be referred to as "a fixing tool."

The spacer 311 is mounted on the bend spacer positioning mechanical section 310. By moving the bend spacer 311 in the axial direction of the center electrode 10 (in the Y axis direction in FIG. 3), the distance between a front end face of the center electrode 10 and the bend spacer 311 is adjusted to a predetermined value, and the bend spacer 311 is positioned such that a predetermined gap is formed between it and the front end face of the center electrode 10.

The bend mechanical section 330 drives the bend roller 331 so as to press the not-yet-bent ground electrode 40A towards the bend spacer 311. As described in detail below, the bend spacer 311 has an abutting surface 319 against which an inner-side side surface 412 of the ground electrode 40 is pressed. The workpiece 150 in which the not-yet-bent ground electrode 40A is joined to the metal shell 30 is mounted on a workpiece holding unit (not shown); and the roller 331 is driven by the bend mechanical section 330 such that, with the spacer 311 disposed at a prescribed position, the not-yet-bent ground electrode 40A is pressed against the abutting surface 319 of the bend spacer 311.

Figure 4:
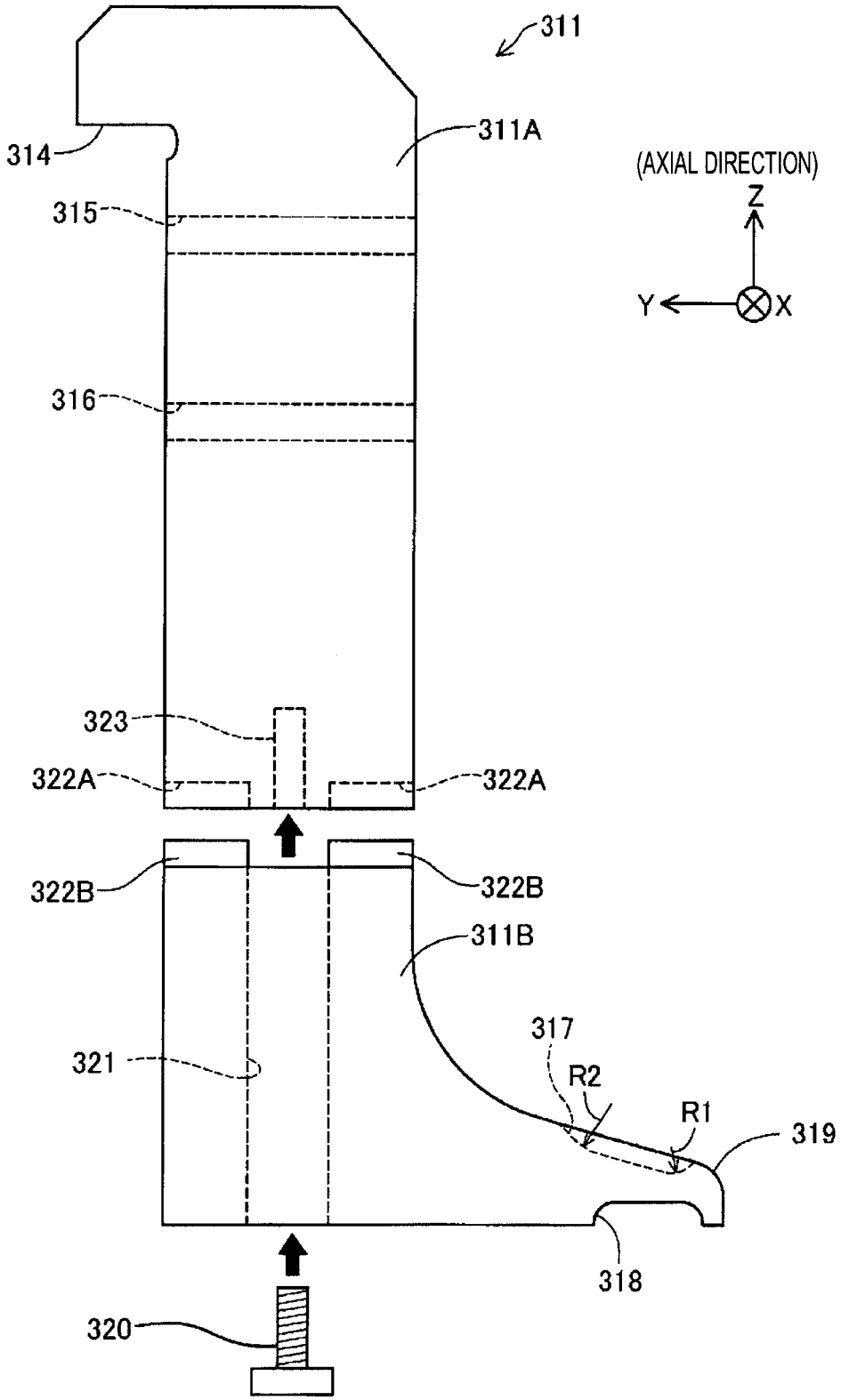
FIG. 4 is an explanatory view for describing a structure of a bend spacer.
Figure 5:
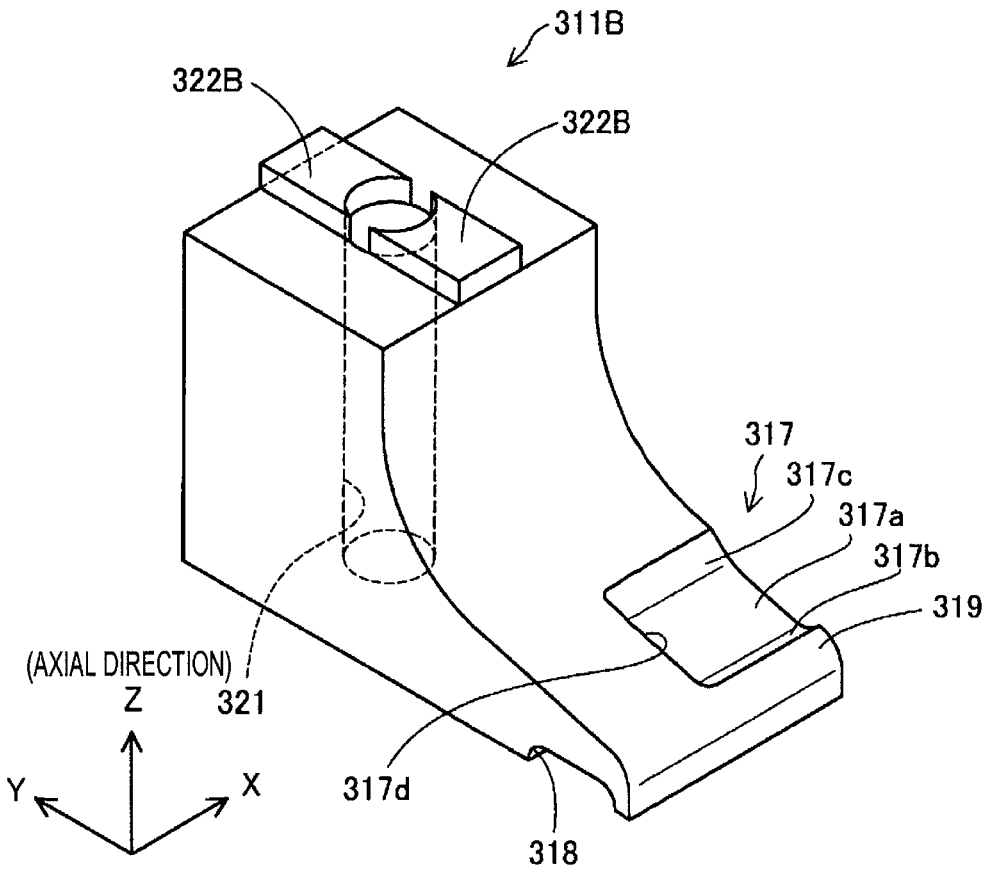
FIG. 5 is a perspective view of an external structure of a second member of the bend spacer.
Figure 6:
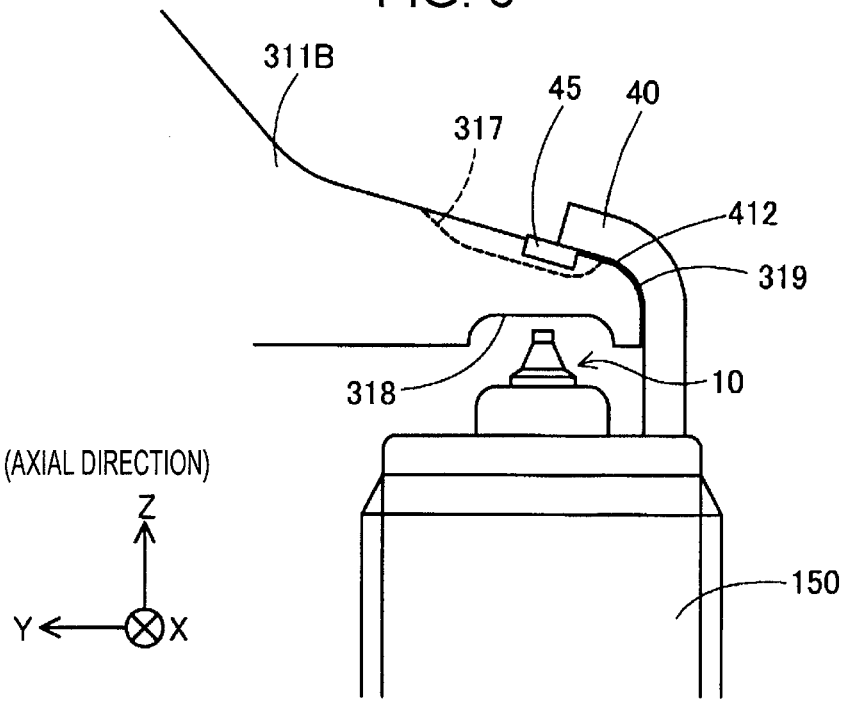
FIG. 6 is an explanatory view for describing preliminary bending.

FIG. 4 is an explanatory view for describing a structure of the bend spacer 311. FIG. 5 is a perspective view of an external structure of a second member 311B of the bend spacer 311. FIG. 6 is an explanatory view for describing the preliminary bending.

As shown in FIG. 4, the bend spacer 311 is such that a first member 311A and the second member 311B are combined with each other, and are fastened and joined to each other with a screw 320. The first member 311A is formed of an alloy-tool-steel steel material SKS3 (JIS G 4404:2006), and the second member 311B is formed of a high-speed-tool-steel steel material SKH54 (JIS G 4403:2006). The hardness of the first member 311A is high, and the toughness of the first member 311A is higher than that of the second member 311B. The toughness of the second member 311B is less than the toughness of the first member 311A. However, the hardness of the second member 311B is even higher than the hardness of the first member 311A. The Rockwell hardness test (JIS Z 2245:2011) in which the first member 311A and the second member 311B were used showed that the hardness of the first member 311A (formed of SKS3) was less than HRC20 and the hardness of the second member 311B (formed of SKH54) was HRC62 to 66.

The first member 311A includes an engaging portion 314, internally threaded holes 315, 316, and 323, and two concave portions 322A. The engaging portion 314, and the threaded holes 315 and 316 are formed for mounting the bend spacer 311 on the bend spacer positioning mechanical section 310. The bend spacer 311 is mounted on the bend spacer positioning mechanical section 310 by engaging the engaging portion 314 of the first member 311A with the bend spacer positioning mechanical section 310 (FIG. 3), and fastening the engaging portion 314 to the bend spacer positioning mechanical section 310 by using bolts 312 and 313 via the threaded holes 315 and 316 in the first member 311A. The threaded hole 323 and the two concave portions 322A are formed for joining the first member 311A and the second member 311B to each other.

As shown in FIG. 5, the second member 311B has a substantially truncated square pyramidal shape including a curved side surface. The second member 311B includes an abutting surface 319 (curved surface), a grooved portion 317, a concave portion 318, a through hole 321, and two convex portions 322B. The through hole 321 and the two convex portions 322B are formed for joining the first member 311A and the second member 311B to each other. The two convex portions 322B of the second member 311B have shapes that allow them to be fitted to the two respective concave portions 322A in the first member 311A. As shown in FIG. 4, by fitting the two convex portions 322B of the second member 311B to the two respective concave portions 322A in the first member 311A, and screwing the screw 320 into the threaded hole 323 in the first member 311A via the through hole 321 in the second member 311B, the first member 311A and the second member 311B are joined to each other. In the embodiment, the spacer 311 includes two members, that is, the first member 311A and the second member 311B; and has a fitting structure in which the concave portions 322A and the convex portions 322B that are fitted to each other are provided at the first member 311A and the second member 311B, respectively, at a joining surface between the first member 311A and the second member 311B. Therefore, for example, in the case where the second member 311B has been broken and is to be replaced, when the concave portions 322A and the convex portions 322B are fitted to each other, it is possible to easily join the first member 311A and the second member 311B to each other with the first member 311A and the second member 311B being disposed in a proper arrangement.

As shown in FIG. 6, the abutting surface 319 of the second member 311B is a surface against which the inner-side side surface 412 of the ground electrode 40 is pressed, and is a curved surface corresponding to the bending shape of the ground electrode 40. When preliminary bending is performed, the concave portion 318 is a hollow in which the center electrode 10 is disposed. The abutting surface 319 in the embodiment may also be referred to as "a predetermined curved surface."

The grooved portion 317 is formed in the abutting surface 319 so as to allow the electrode tip 45 to be accommodated in the grooved portion 317 without contacting the bend spacer 311 when preliminary bending is performed on the not-yet-bent ground electrode 40A. As shown in FIG. 5, the grooved portion 317 is a hollow having a substantially truncated square pyramidal shape, and includes a bottom surface 317*a*, a first side surface 317*b* at the front end side of the bend spacer 311, a second side surface 317*c* opposing the first side surface 317*b*, and a third side surface 317*d* that is connected to the first side surface 317*b* and the second side surface 317*c*. The first side surface 317*b* and the bottom surface 317*a* are connected to each other so as to be rounded to a radius R1, and the second side surface 317*c* and the bottom surface 317*a* are connected to each other so as to be rounded to a radius R2, with the radius R1<the radius R2 (FIG. 4). Although, in the embodiment, R1=3.0 mm and R2=0.5 mm, the present invention is not limited thereto, so that it is possible to set the radii so as to have magnitudes that allow stress concentration to be reduced.

When preliminary bending is performed on the not-yet-bent ground electrode 40A, as shown in FIG. 6, the bend roller 331 applies a load for bending the not-yet-bent ground electrode 40A to the abutting surface 319 of the second member 311B of the bend spacer 311. When stress concentrates at a portion of the second member 311B that includes the grooved portion 317 due to the load applied by the roller 331, the portion at which the stress concentrates tends to break (crack). In the embodiment, when, in the grooved portion 317, the radius R2 of a rounded portion of the connection portion between the second side surface 317*c* and the bottom surface 317*a*, where a relatively large stress is exerted, is made large, it is possible to suppress the concentration of stress and to suppress the occurrence of breakage of the second member 311B.

Figure 7:
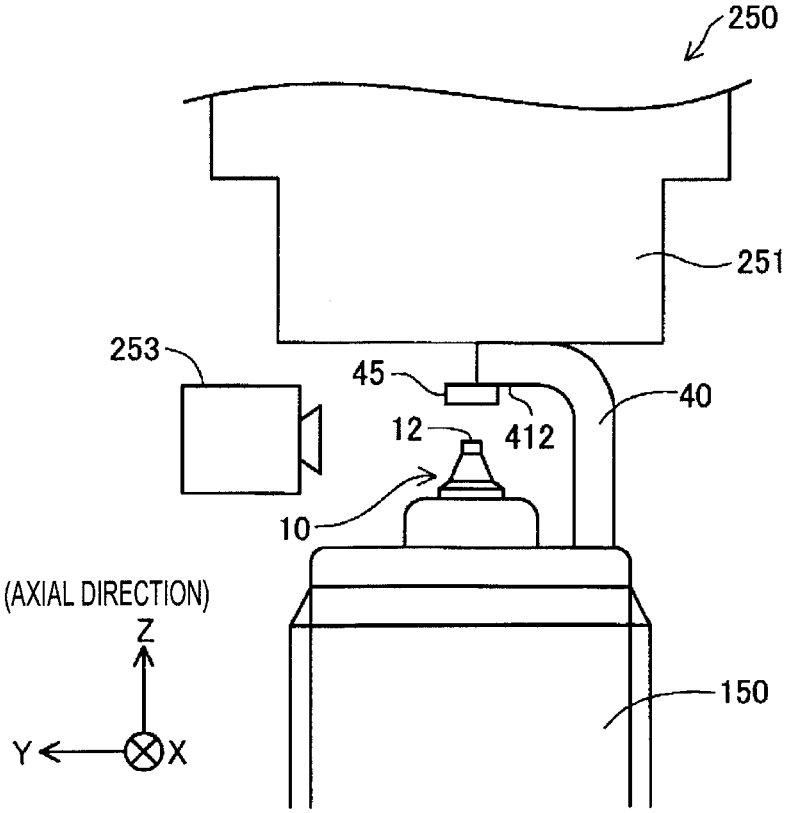
FIG. 7 is an explanatory view for describing main bending.

FIG. 7 is an explanatory view for describing the main bending (Step S184). A main bending device 250 includes a main bending punch 251 that is drivable in an up-down direction (the Z-axis direction). In Step S184 (FIG. 2), the main bending punch 251 comes into contact with the ground electrode 40 that has been subjected to the preliminary bending from above the ground electrode 40, and the ground electrode 40 is subjected to the main bending such that the inner-side side surface 412 of the distal end of the ground electrode 40 is parallel to the front end face 12 of the center electrode 10. The main bending is performed in stages while monitoring the interval between the electrode tip 45 and the front end face of the center electrode 10 by a CCD camera 253, and the spark discharge gap G having a predetermined size is formed. In this way, the spark plug 100 is completed.

By repeating the Steps S10 to S18 described above, a plurality of spark plugs 100 are successively manufactured. If the second member 311B of the bend spacer 311 has been broken while successively manufacturing the plurality of spark plugs, a step of replacing the second member 311B is performed before Step S18. When the first member 311A has been broken, similarly, a step for replacing the first member 311A is performed before Step S18.

As described above, in the preliminary bending step of bending the not-yet-bent ground electrode 40A of the spark plug 100, since a bending load acts upon the spacer 311, breakage may occur in a mounting portion of the spacer 311 that is mounted on the bend spacer positioning mechanical section 310 (the first member 311A) or the grooved portion 317 of the second member 311B. According to the method for manufacturing the spark plug according to the embodiment, in the preliminary bending step, the bend spacer 311 that is formed so as to be divisible into two members (the first member 311A and the second member 311B) is used. Therefore, when one of the first member 311A and the second member 311B has been broken, only the broken member needs to be replaced. Consequently, compared to the case in which the entire spacer 311 is to be replaced, it is possible to reduce tool replacement costs, and to reduce manufacturing costs of the spark plug 100. For example, when the second member 311B is broken (cracked), the accuracy of the spark discharge gap in the spark plug 100 may be decreased. However, by replacing the second member 311B, it is possible to stably form the spark discharge gap with good accuracy.

The spacer 311 that is used in the method for manufacturing the spark plug according to the embodiment is such that the first member 311A and the second member 311B have the so-called fitting structure. Therefore, when one of the members is to be replaced, it is possible to easily and properly combine the first member 311A and the second member 311B to each other by fitting the convex portions 322B of the second member 311B to the concave portions 322A in the first member 311A. Consequently, according to the method for manufacturing the spark plug according to the embodiment, since it is possible to, when the first member 311A or the second member 311B of the bend spacer 311 has been broken, properly replace the member in a short time, it is possible to suppress an increase in the manufacturing time of the spark plug, and to suppress a reduction in productivity.

The spacer 311 that is used in the method for manufacturing the spark plug according to the embodiment is such that the first member 311A and the second member 311B are made of different steel materials, the toughness of the first member 311A is higher than the toughness of the second member 311B, and the hardness of the second member 311B is higher than the hardness of the first member 311A. Since the roller 331 applies a large load to the bend spacer 311, a hardness that is high enough to prevent breakage (cracking) by the load is required. In the spark plug 100 according to the embodiment, since the ground electrode 40 is shorter in length than in existing structures (a structure in which the electrode tip 45 does not protrude from the distal end of the ground electrode 40 or a structure that does not include the electrode tip 45), when preliminary bending is performed on the not-yet-bent ground electrode 40A, the load (stress) that acts upon the spacer 311 is larger than in existing structures, and the probability with which the bend spacer 311 is broken is increased. Therefore, increasing the overall hardness of the bend spacer 311 was considered. However, an increase in the overall hardness increases the probability with which breakage occurs in the mounting portion of the bend spacer 311 that is mounted on the bend spacer positioning mechanical section 310. Consequently, the bend spacer 311 is formed so as to be divisible, the first member 311A is formed as a member having high hardness and high toughness, and the second member 311B is formed as a member having a toughness that is less than that of the first member 311A and having a hardness that is higher than that of the first member 311A. Therefore, the bend spacer 311 is a well-balanced tool, and breakage thereof is unlikely to occur. Consequently, it is possible to reduce tool replacement costs and to reduce manufacturing costs of the spark plug.

In the spacer 311 that is used in the method for manufacturing the spark plug according to the embodiment, when, in the grooved portion 317 of the second member 311B, an angle R of a portion where a stress corresponding to the load applied by the bend roller 331 concentrates is large, it is possible to suppress the concentration of stress and to suppress the occurrence of breakage of the second member 311B. As a result, it is possible to reduce the time and costs required to replace the member of the bend spacer 311 in the step of manufacturing the spark plug, reduce manufacturing costs of the spark plug, and suppress a reduction in production efficiency.

B. Modifications

The present invention is not limited to the above-described embodiment, and various structures can be realized within a scope that does not depart from the gist thereof. For example, any of the technical features in the embodiments corresponding to the technical features in the aspect and forms described in the "Summary of Invention" section may be replaced with another or may be combined with another as appropriate for solving some or all of the aforementioned problems or for achieving some or all of the aforementioned advantages. If the technical features thereof are not described as being essential in the specification, they may be omitted as appropriate. For example, the following modifications are possible.

B-1. First Modification

Although, in the above-described embodiment, the structure in which the electrode tip 45 is joined to the distal end of the ground electrode 40 with the electrode tip 45 protruding from the distal end face of the ground electrode 40 is described as an example, the present invention is not limited thereto. For example, the electrode tip 45 may be joined inwardly (−Y axis side) from the distal end face of the ground electrode 40. In this case, the ground electrode 40 is longer than that in the above-described embodiment. Further, the electrode tip 45 need not be provided.

B-2. Second Modification

Although, in the above-described embodiment, the structure in which the bend spacer 311 is divisible into two members (the first member 311A and the second member 311B) is described as an example, the structure may be divisible into three or more members. By forming the bend spacer 311 so as to be divisible, when the bend spacer 311 has been, for example, broken, it is possible to replace only the broken member to reduce tool replacement costs.

B-3. Third Modification

The shape of the bend spacer 311 is not limited to that in the above-described embodiment. The bend spacer 311 only needs to include the mounting portion that is mounted on the bend spacer positioning mechanical section 310 and the abutting surface 319 having a curved shape corresponding to the bending shape of the ground electrode 40. The portion of the bend spacer 311 where it is divided is also not limited to that in the above-described embodiment, and may be any appropriate portion.

B-4. Fourth Modification

The shape of each concave portion 322A in the first member 311A and the shape of each convex portion 322B of the second member 311B are not limited to those in the above-described embodiment. They may have any shape as long as they can be fitted to each other. For example, the first member 311A may include the convex portions and the second member 311B may include the corresponding concave portions.

B-5. Fifth Modification

The material of the first member 311A and the material of the second member 311B are not limited to those in the above-described embodiment. For example, the second member 311B may be formed by using the alloy-tool-steel steel material SKS3 used to form the first member 311A. Even if the first member 311A and the second member 311B are formed of the same material, when either one of the members has been broken, since only the broken member can be replaced, it is possible to reduce tool replacement costs. The portion of the second member 311B with which the not-yet-bent ground electrode 40A contacts may be made of a material having a still higher hardness (such as cemented carbide V2).

B-6. Sixth Modification

Although, in the above-described embodiment, the case in which the radius of a rounded portion of the connection portion between the bottom surface and the first side surface of the grooved portion 317 and the radius of the rounded portion of the connection portion between the bottom surface and the second side surface of the grooved portion 317 differ from each other is described as an example, the present invention is not limited thereto. The radii of the rounded portions may be the same.

REFERENCE SIGNS LIST

10 center electrode
12 front end face
19 terminal metal shell
20 insulator
29 axial hole
30 metal shell
31 end face

40 ground electrode
40A unbent electrode
45 electrode tip
50 metal shell
90 internal combustion engine
91 inner wall
92 combustion chamber
100 spark plug
150 workpiece
250 main bending device
251 punch
253 CCD camera
300 preliminary bending device
310 bend spacer positioning mechanical section
311 bend spacer
311A first member
311B second member
312 bolt
314 engaging portion
315, 316, 323 threaded hole
317 grooved portion
317*a* bottom surface
317*b* first side surface
317*c* second side surface
317*d* third side surface
318 concave portion
319 abutting surface
321 through hole
322A concave portion
322B convex portion
330 bend mechanical section
331 roller
412 inner-side side surface
CA axial line

The invention claimed is:

1. A method for manufacturing a spark plug including a center electrode that extends in an axial direction, a metal shell that is provided around an outer periphery of the center electrode, and a rod-shaped ground electrode whose base end is joined to the metal shell and whose distal end is bent towards an axial-line side, the method comprising:

a bending step of bending an unbent ground electrode, which is the ground electrode that is not yet bent, by pressing it against a predetermined curved surface of a bend spacer, wherein the bend spacer is composed of two or more members including a first member and a second member that can be separated from each other, the first member including a mounting portion for mounting the bend spacer on a fixing tool, the second member including the predetermined curved surface that comes into contact with the unbent ground electrode.

2. The method for manufacturing the spark plug according to claim 1, wherein, one of the two or more members includes a convex portion and another of the two or more members includes a concave portion that is fitted to the convex portion.

3. The method for manufacturing the spark plug according to claim 1, wherein a toughness of the first member of the bend spacer is higher than a toughness of the second member, and a hardness of the second member is higher than a hardness of the first member.

4. The method for manufacturing the spark plug according to claim 1, wherein the ground electrode further includes an electrode tip that is joined to the distal end and is disposed so as to oppose the center electrode with a predetermined gap therebetween, wherein the bend spacer includes a grooved portion in the predetermined curved surface, the grooved portion being capable of accommodating the electrode tip, the grooved portion includes a first side surface disposed at a front end side of the second member of the bend spacer, a bottom surface that is continuous with the first side surface, and a second side surface that opposes the first side surface and that is continuous with the bottom surface, and the first side surface and the bottom surface are connected to each other so as to be rounded to a radius R1, and the second side surface and the bottom surface are connected to each other so as to be rounded to a radius R2, with the radius R1 being less than the radius R2.

5. The method for manufacturing the spark plug according to claim 1, further comprising a replacing step of replacing any one of the members of the bend spacer that have been broken, the replacing step being performed before the bending step.

6. The method for manufacturing the spark plug according to claim 2, wherein the first member contains the concave portion and the second member contains the convex portion.

* * * * *